United States Patent [19]

Salomon

[11] 4,402,525

[45] Sep. 6, 1983

[54] SKI SAFETY BINDING

[75] Inventor: Georges P. J. Salomon, Annecy, France

[73] Assignee: Etablissements Francois Salomon et Fils Chemin de la Prairie Prolonge, Annecy, France

[21] Appl. No.: 276,293

[22] Filed: Jun. 22, 1981

Related U.S. Application Data

[63] Continuation of Ser. No. 31,803, Apr. 20, 1979, abandoned.

[30] Foreign Application Priority Data

Apr. 28, 1978 [FR] France ..... 78 12741

[51] Int. Cl.[3] ..... A63C 9/00

[52] U.S. Cl. ..... 280/628

[58] Field of Search ..... 280/628, 629, 630, 631, 280/632, 626, 623, 611, 634

[56] References Cited

U.S. PATENT DOCUMENTS

| | | | |
|---|---|---|---|
| 3,027,173 | 3/1962 | Beyl | 280/629 |
| 3,430,971 | 3/1969 | Berlenbach | 280/629 |
| 3,693,989 | 9/1972 | Forcht | 280/628 |
| 3,709,510 | 1/1973 | Gotz | 280/628 |
| 3,722,902 | 3/1973 | Marker | 280/628 |
| 4,081,180 | 3/1978 | Beyl | 280/628 |
| 4,095,821 | 6/1978 | Solomon | 280/628 |
| 4,358,132 | 11/1982 | Beyl | 280/628 |

FOREIGN PATENT DOCUMENTS

| | | |
|---|---|---|
| 2049433 | 3/1971 | France . |
| 2074115 | 10/1971 | France . |
| 2418656 | 9/1979 | France . |
| 481661 | 1/1970 | Switzerland . |

*Primary Examiner*—Joseph F. Peters, Jr.

*Attorney, Agent, or Firm*—Pollock, Vande Sande & Priddy

[57] ABSTRACT

A ski safety binding of the "compensating" type having a binding unit mounted on a vertical pivot and a boot-retention arrangement including laterally operable jaws and a vertically movable retention element. A spring-loaded locking system opposes vertical and lateral retention forces, respectively, upon vertical and lateral displacement of the boot. The compensating system, which acts against the spring load, causes the lateral and vertical retention forces to vary inversely with one another.

8 Claims, 12 Drawing Figures

SKI SAFETY BINDING

This is a continuation of application Ser. No. 031,803, filed Apr. 20, 1979, now abandoned.

SUMMARY OF THE INVENTION

The present invention relates to a safety binding for skis of the so-called "compensating" type, comprising a mechanism that acts on the resilient device of the binding so that the lateral retention force exerted by the locking system varies inversely with the vertical retention force. In this manner, the binding can respond, while maintaining lateral safety, to any twisting constraint on the leg, regardless of the vertical force with which the boot is held, particularly in the case of abnormally thick layers of snow between ski and boot, or in the case of stresses caused by a so-called backward fall.

BACKGROUND OF THE INVENTION

Already known in the art are bindings of at least the lateral release type which comprise a vertical pivot rigidly attached to the ski, a binding unit mounted for rotation on the pivot and comprising means for retaining the boot, a locking system mounted in the binding unit and assuring a firm hold of the boot on the ski, this locking system comprising resilient means opposing a vertical retention force and a lateral retention force, respectively, acting to cause lifting and lateral shifting of the boot, and which is pre-adjusted to permit release of the boot when it is subjected to predetermined constraints; and a compensating mechanism which acts against the action of the resilient means so as to cause the lateral retention force due to the locking system to vary in inverse ratio to the variation in the vertical retention force, this compensating mechanism comprising on the one hand, two elements movably mounted in the binding unit and forced against a rigid body by the locking system and, on the other hand, a member tied to the vertical movements of the boot-retaining means, said member cooperating with one of the movable elements to separate it from the rigid body when the retaining means are displaced vertically, while it exerts no force on the second movable element which is pressed against said rigid body.

The object of the present invention is an improvement for this type of compensating binding, in accordance with which the locking system comprises a resilient device one of whose extremities rests on one of the movable elements and the other of whose extremities rests on a part that is rigidly connected to the other movable element, thus assuring that the movable elements are forced against the rigid body.

In the preferred embodiment, in which the rigid body comprises the fixed pivot, the latter presents two diametrcially opposed flat parts, and each of the elements is pressed against one of these. In addition, at least one of the movable elements has an extension in the direction of the other element in relation to the pivot. The resilient device is thus inserted between the second movable element and the extension of the first movable element, and it forces the two elements on either side of the pivot.

In accordance with one possible embodiment, one at least of the two movable elements is so mounted that it is capable of translatory motion within the binding unit. In another embodiment, at least one of the movable elements can swing about an axis so that it can be separated from the pivot. Moreover, the opposing flat parts of the pivot or of the rigid body advantageously have different dimensions (in particular their width), and the movable element that cooperates with the member tied to the vertical movements of the fastening means rests on the flat part having the greater dimension.

BRIEF INTRODUCTION TO THE DRAWINGS

In order that the invention may be more clearly understood, reference will now be made to the attached drawings in which:

FIG. 6);

DESCRIPTION OF PREFERRED EMBODIMENT

Figure 1:
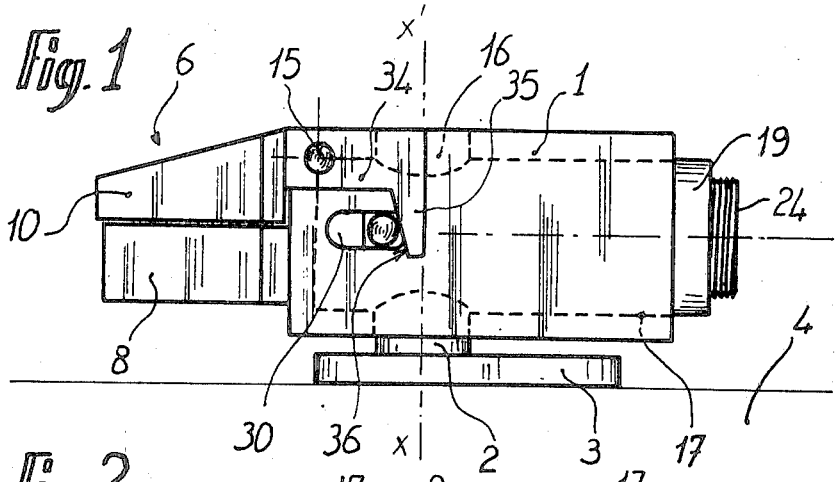
FIG. 1 is a side view of a first embodiment of a binding in accordance with the invention.
Figure 2:
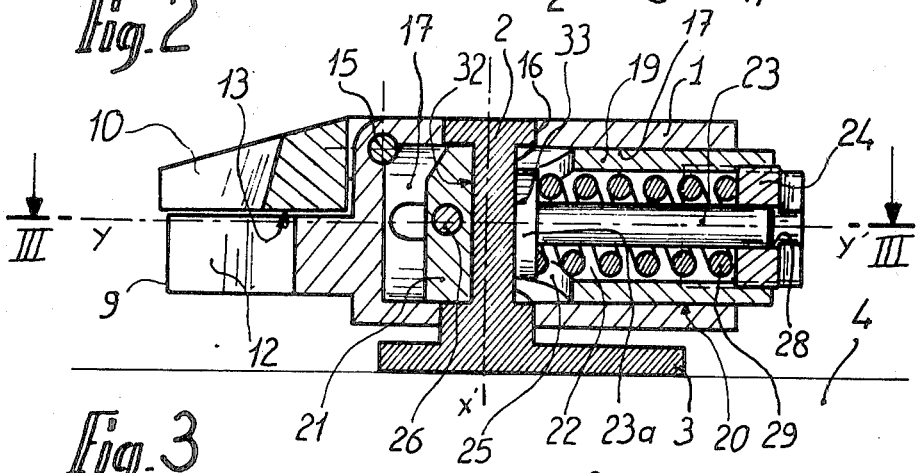
FIG. 2 is a longitudinal section of the binding of FIG. 1 along line II—II in FIG. 3.

In the description which follows, identical parts have been assigned the same reference number.

The binding comprises a unit 1, mounted for rotation about a substantially vertical pivot 2 rigidly connected to a base plate 3 which is attached to the ski 4, for example by means of screws 5.

The binding unit comprises retention means for the boot generally designated as 6 and illustrated in FIG. 1 as a lateral U-shaped retention jaw with two wings 8 and 9 and a vertical retention element 10 also comprising a U-shaped jaw which adjusts to the top of the sole. Thus, the boot is retained laterally on the ski by means of the lateral rims 11 and 12 of jaw 8, 9 and it is retained vertically by means of rim 13 of jaw 10. It should be noted that the boot may or may not be in contact with face 14 of the lower jaw 8, 9. In the preferred embodiment of the invention shown in FIGS. 1 to 7, the lateral retaining elements 8, 9 are rigidly connected to unit 1 and the vertical retention element 10 is mounted for free rotation with respect to unit 1 about a pivoting axis 15 rigidly connected to unit 1 and disposed parallel to the plane of the ski and transversely to the latter's longitudinal axis. Pivoting unit 1 has a vertical hole 16 vertically traversing said unit and a horizontal cylindrical housing 17 opening onto the side of the unit opposite to retention means 6. Pivot 2 is set in hole 16 and thus defines a pivoting axis X-X' for unit 1. Inside housing 17 is mounted a hollow cylinder (or casing) 19 which is fitted in the housing for longitudinal sliding movement along axis Y-Y' of housing 17. This hollow cylinder comprises the first movable part of the compensating mechanism and it has a lateral wall 20 and a bottom 21, the inside end of wall 20 opposite bottom 21 being threaded to accomodate screw plug 24. In addition, a transverse passage 25 extends perpendicular to axis Y-Y' and passes all the way through the hollow cylinder so that it can be fitted over pivot 2. As shown in FIGS. 2 to 7, passage 25 is of elongated shape so that the hollow cylinder can move in relation to the pivot.

In the internal chamber 22 of hollow cylinder 19 is mounted a second movable element 23 of the compensating mechanism, this second element being shown in FIGS. 1 to 7 in the shape of a piston 23 with a round head 23*a* connected to a rod extending along axis Y-Y', the free end of the rod passing through aperture 28 in plug 24.

A spring 29 which comprises the resilient device in the resilient locking system of the binding surrounds the rod and abuts on the one side on head 23*a* of piston 23 and on the other side on plug 24 set in hollow cylinder 19. It will be noted that screwing the plug makes it possible to adjust the tension of spring 29.

Figure 3:
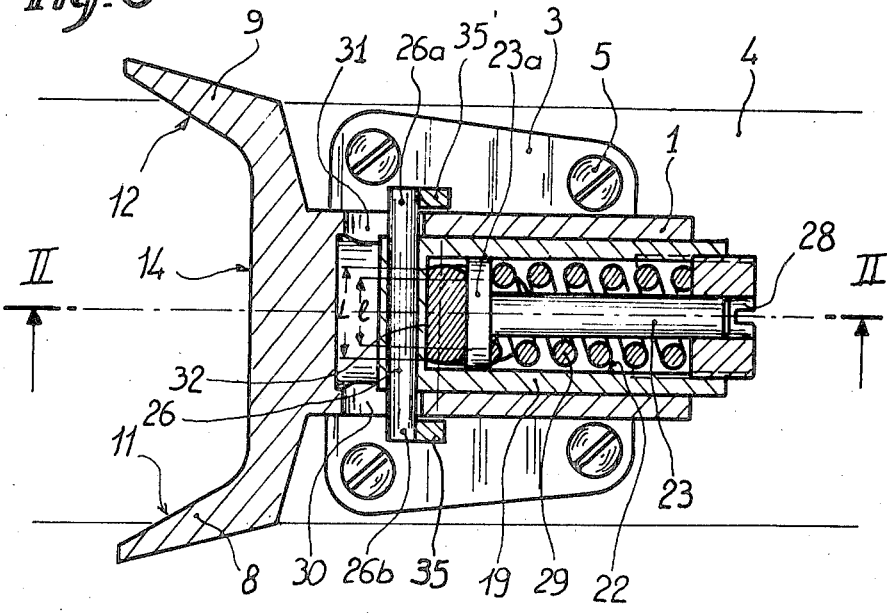
FIG. 3 is a cross-section along line III—III in FIG. 2.

As shown in the drawing, bottom 21 of cylinder 19 and head 23*a* of the piston are mounted in opposition on either side of pivot 2, and spring 29 forcefully biases them against respectively, flat parts 32 and 33 machined into the pivot so as to be diametrically opposed. It should be noted that the width L of flat part 32 (measured along a plane parallel to the width of the ski, as seen in FIG. 3) is greater than the width l of flat part 33. The reason for this difference in the dimensions of the flat parts is given below. It is stressed that this $L>l$ feature is a function of the desired degree of compensation and that one could just as well have two flat parts of equal width.

At the bottom 21 of hollow cylinder 19 is mounted a crosspiece 26 which laterally extends beyond said hollow cylinder. The projecting crosspiece ends 26*a* and 26*b* extend into oblong openings 30 and 31 drilled symmetrically into binding unit 1, the crosspiece thus extending outside said unit so as to cooperate with fingers 35 and 35' (FIGS. 1 and 3) which are prolongations of two lateral wings 34 rigidly connected to clamping jaw 10 (usually called "sole gripper") and which extend beyond axis 15 in relation to jaw 10. Fingers 35 are located behind extensions 26*a*, 26*b* of crosspiece 26 and they have an inclined ramp 36 against which the corresponding crosspiece extension is made to rest. It can readily be seen that any elevation of jaw 10 causes hollow cylinder 19 to shift against the pressure of spring 29 with the aid of fingers 35 and of crosspiece 6, which is thus shown to be closely tied to the vertical movements of boot-retaining jaw 10.

The manner of operation of the binding will now be explained, with reference to FIGS. 4 to 9.

Figure 4:
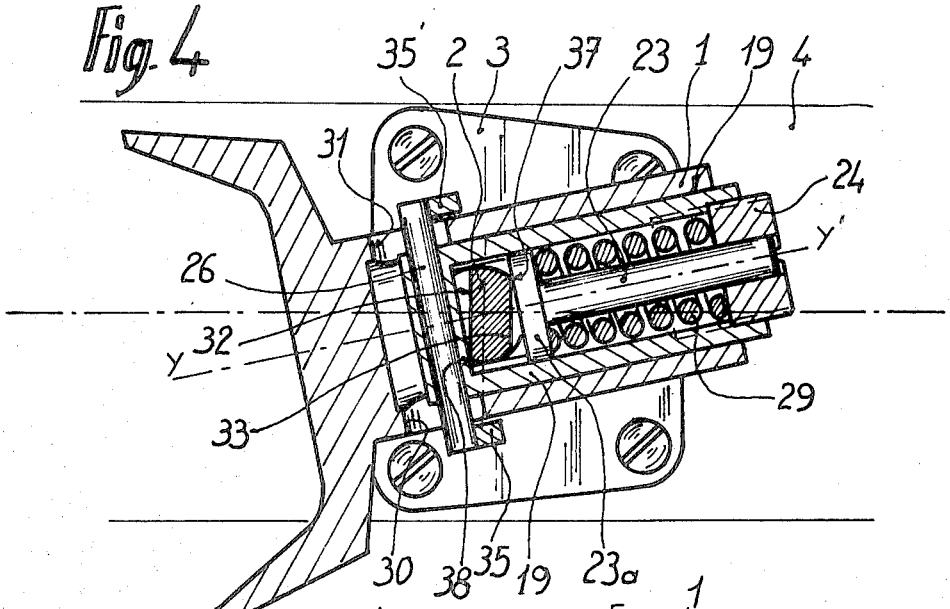
FIG. 4 is a view similar to FIG. 3, showing the binding in the course of a purely lateral release.
Figure 8:
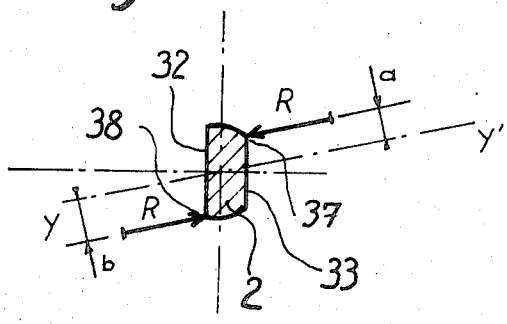
FIG. 8 is a schematic view showing the rigid body and the stresses applied to it during purely lateral restraint.

First, let us consider the case when no stress is being applied vertically on jaw 10 and when a torsion effect brings about purely lateral release; this case is represented by FIGS. 4 and 8.

When there is rotation of the body owing to a shift of the boot in the plane of the ski, as shown in FIGS. 4 and 8, pivot 2, in a sense, acts as a lever between the two movable elements (hollow cylinder 19 and piston 23) by pushing them back simultaneously against the pressure of spring 29. The edge 37 of flat part 33 of pivot 2 pushes back piston 23 and edge 38 pushes back hollow cylinder 19, which causes compression of the spring.

The value of the lateral release is a function, mainly, of the moment of resilient recovery of the binding. If this release value is called D, the moment of resilient recovery is a function of Rb+Ra (cf. FIG. 8), R being the force of the spring, Ra being the action of piston 23 on pivot 2 along edge 37, and Rb being the action of hollow cylinder 19 on pivot 2 along edge 38.

We can formulate this as follows:

D is a function of R(a+b), or $$D=f[R(a+b)]$$

In this equation, a is the distance between edge 37 and axis Y-Y', and b is the distance between edge 38 and axis Y-Y'.

Let us now examine the case where a vertical force is exerted on jaw 10 at the same time that a lateral force is applied to jaw 8, 9 as, for example, during lateral release with vertical stress from the rear. This may be the case when there is combination of lateral fall and backward fall, or when there is a thick layer of snow between boot and ski.

Figure 5:
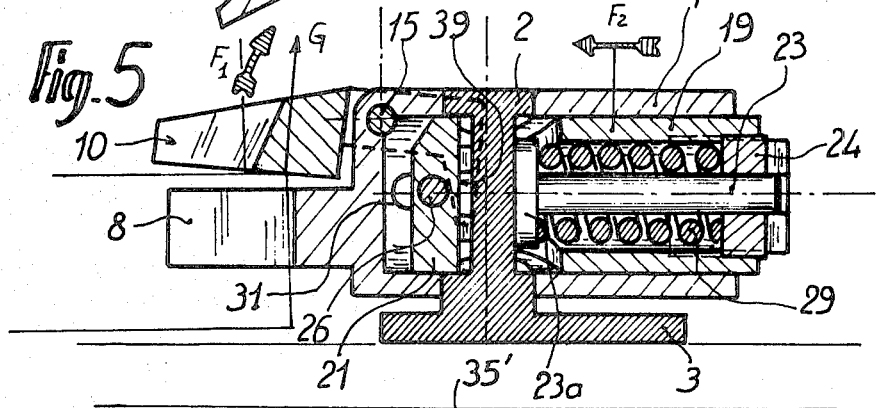
FIG. 5 is a view similar to FIG. 2, showing the binding while subjected to a vertical force.
Figure 6:
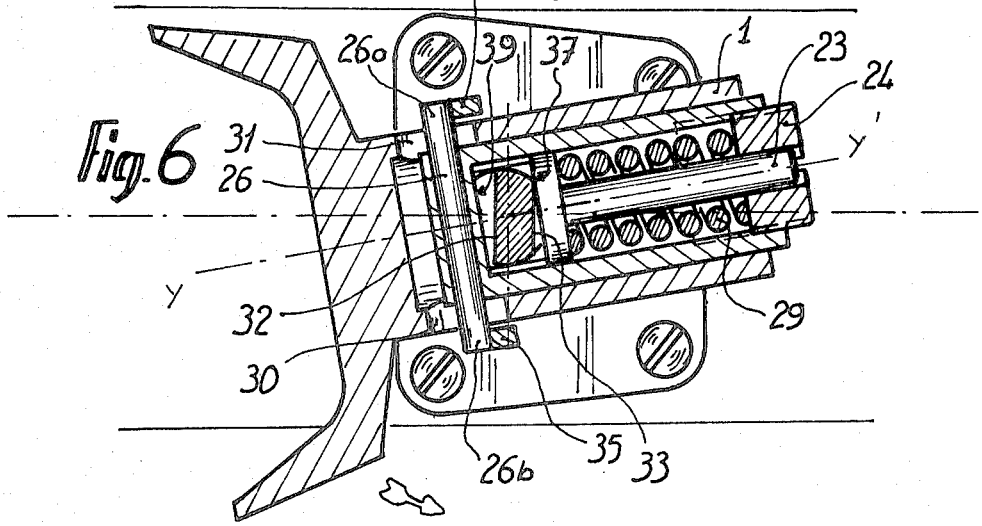
FIG. 6 is a view similar to FIG. 3, showing the binding while subjected to combined lateral and vertical constraints.
Figure 7:
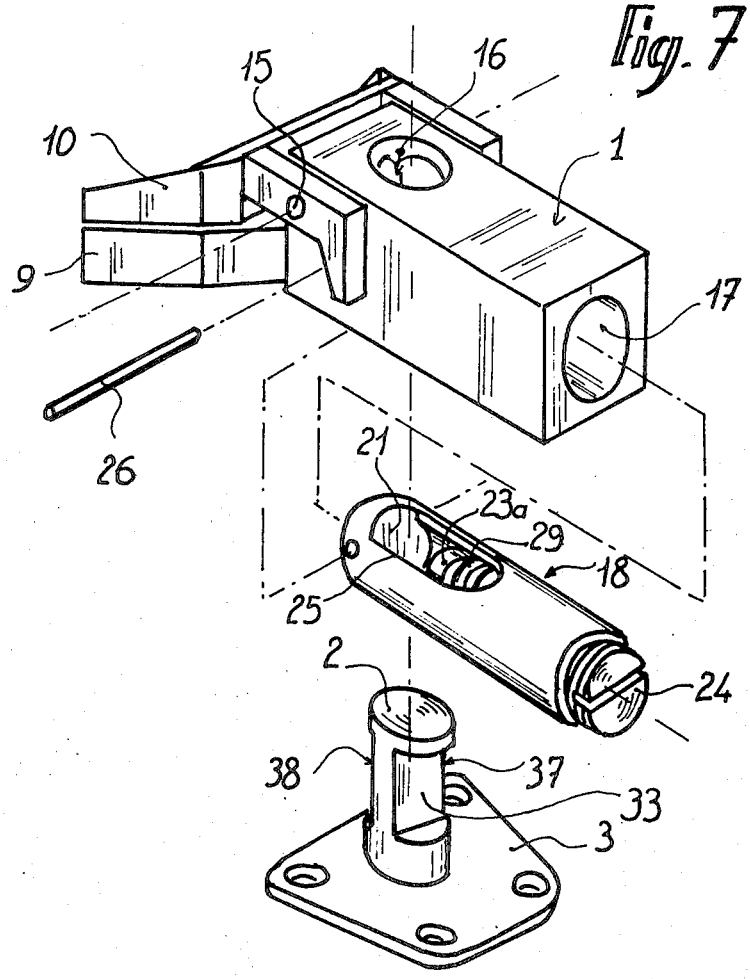
FIG. 7 is an exploded perspective view of the binding shown in FIG. 1.
Figure 9:
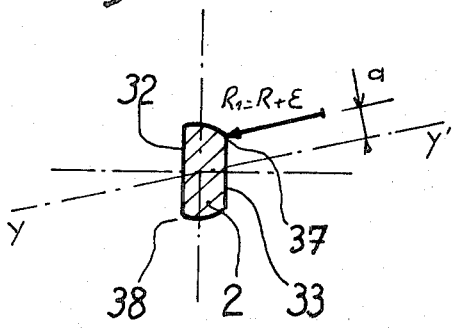
FIG. 9 is a schematic diagram showing the rigid body and the stresses applied to it during a combined constraint with compensation (cf.

FIGS. 5, 6 and 9 illustrate this problem. When there is stress from the rear, the action of the sole on the sole-gripper raises it in the direction of arrow $F_1$ (FIG. 5) by rotation about axis 15. As a result, fingers 35 and 35', in cooperation with crosspiece 26, force hollow cylinder 19 in the direction of arrow $F_2$ in FIG. 5. This displacement causes a separation of flat part 39 from the bottom of cylinder 19 with respect to the pivot. This motion is a resilient one against the pressure exerted by spring 29. When there is a release in the lateral direction while the binding is in the position shown in FIG. 5, piston 23, alone, constitutes the driving element for the lateral pivoting of the binding (FIG. 6), hollow cylinder 19 retaining the boot elastically in the vertical direction.

Inasmuch as there is an upward constraint owing to the action of the boot on sole-gripper 10, there arises a force G (FIG. 5) whose direction is upward and substantially vertical. This force causes a certain stray friction "g" between sole and sole-gripper which is opposed to the lateral release, and if there were no compensation, the level of the lateral release would be markedly raised. But, because of the separation of hollow cylinder 19 from the corresponding flat part of the pivot, only piston 23 acts on pivot 2, taking its bearing on edge 37.

Under these conditions, the value $D_1$ of the lateral release is a function of $R_1$ a+"g", where $R_1=R+\epsilon$, because there is a supplementary compression of the spring owing to the shift of hollow cylinder 19 in the direction of arrow $F_2$.

This may be formulated as follows:

$$D_1=f(R+\epsilon)a+g$$

If $D_1$ is compared with D, it is found that the added component of friction "g" has been compensated for by a reduction in the total lateral resilient moment of resistance, and it is possible to operate so as to make $D_1$ substantially equal to D.

The compensation is thus a function of the stiffness of the spring and of the value of a and b, i.e., of L and l.

Figure 10:
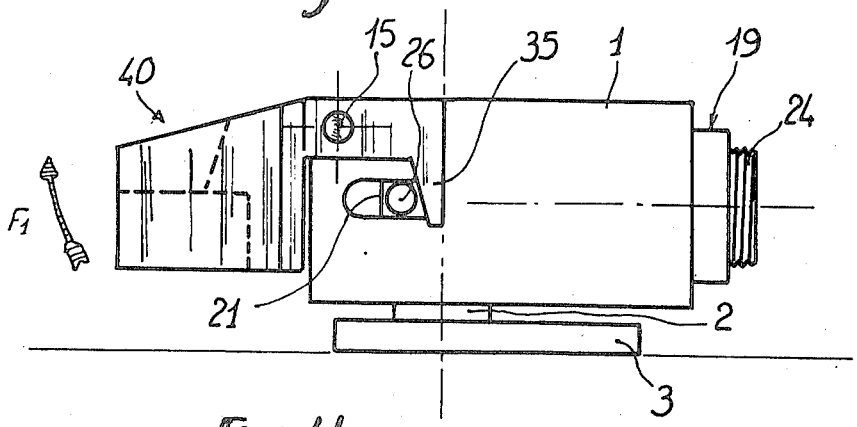
FIG. 10 is an elevation of another embodiment of the invention.

FIG. 10 shows an embodiment of the invention in which the entire set of lateral and vertical retention devices is unified in a single bloc, and this unit is mounted for rotation in direction $F_1$ on pivot axis 15.

The remainder of the binding is identical to that of FIGS. 1 to 9.

Figure 11:
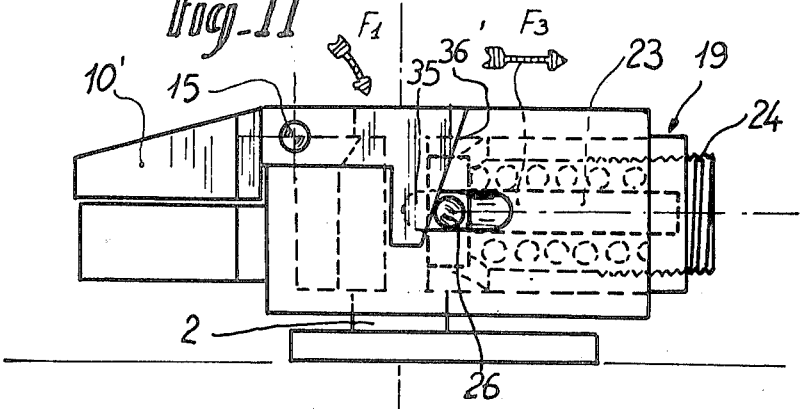
FIG. 11 shows a further embodiment.

FIG. 11 shows an embodiment in which the element tied to the vertical movements of the boot, i.e., crosspiece 26, is attached to piston 23 rather than to hollow cylinder 19. It will be obvious that, in this case, fingers 35 attached to jaw 10′ push the crosspiece back in the direction of arrow $F_3$, and inclined plane 36′ is located ahead of the crosspiece.

Figure 12:
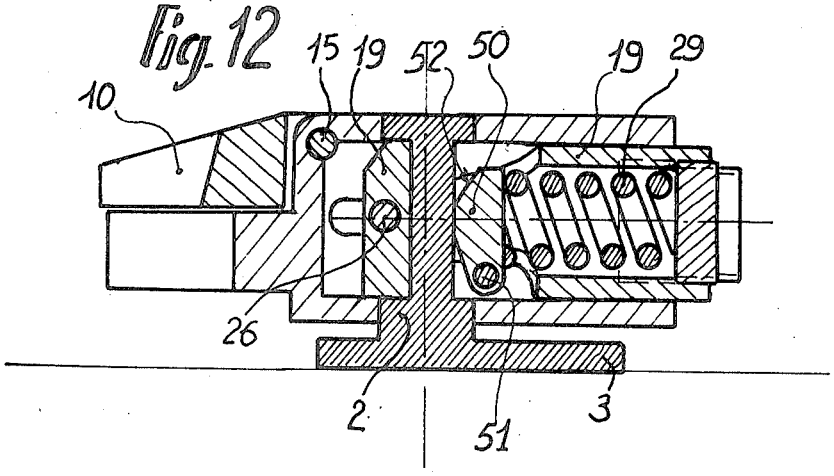
FIG. 12 is a longitudinal section of yet another embodiment.

Finally, FIG. 12 shows a longitudinal section of an embodiment in which one of the elements (hollow cylinder 19) is free to move in translation, while the other (element 50) is free to move in rotation. Element 50, constituted by a rocker arm, is mounted for pivoting movement on axis 51 which is rigidly connected to unit 1. In this embodiment it is the element having freedom of translatory movement, i.e., element 19, which is sensitive (as in FIG. 1) to the vertical motion of jaw 10.

Obviously, just as in FIG. 11, it is element 50 which could be made sensitive to vertical motion in jaw 10 rather than element 19, e.g., by means of the cooperation of lateral fingers extending from jaw 10 for engagement with an inclined plane 52 of element 50.

Another variant would be a design wherein axis 51 for the rocker arm is mounted on hollow cylinder 19 rather than on the binding unit.

It should be noted that the resilient device, in the described examples, advantageously comprises a single compression spring, but that it could also comprise two or more compression springs, either one inside the other or side-by-side. It could also be made up of one or more traction springs.

Also, the pivot need not be perpendicular to the ski. It could be inclined in the plane of symmetry of the ski perpendicular to the latter.

In the above description, the invention has been applied for a binding designed for maintaining the front end of a boot. However the invention could also be applied for a binding designed for maintaining the rear end of the boot, or a plate at least temporarily fixed under the boot or even the sole of a boot carrying binding means.

What is claimed is:

1. A safety binding for a boot on a ski with at least lateral release, comprising (a) a substantially vertical pivot rigidly connected to a base plate fixed on the ski and having two flat parts diametrically opposed and disposed perpendicularly to the longitudinal axis of said ski;

(b) a body mounted for pivoting movement on said pivot and having boot retaining means thereon, a vertical boot retaining means being mounted for rotation on said body about an axis parallel to the plane of said ski and transversely to its longitudinal axis; and (c) a locking and compensating system mounted in said body, comprising spring means and assuring retention of said boot on said ski in a fixed position, said locking system cooperating with the flat parts of said pivot and with said vertical boot retaining means for opposing a lateral retention force and a vertical retention force, respectively, upon lateral displacement and lifting of said boot, said locking system being adjusted to permit release of said boot when it is subjected to a predetermined level of stress, said locking system comprising two movable elements in said body, each of said movable elements being forced by said spring means against one of said flat parts, the first of said movable elements being forced against said flat part turned to said boot and comprising an extension in the direction of the second of said movable elements and said spring means being inserted between said second movable element and said extension of said first movable element, thereby forcing said two elements against the two flat parts of said pivot, and said vertical boot retaining means cooperating with said first movable element to separate it from the corresponding flat part when said vertical boot retaining means are displaced vertically, while it exerts no action on said second movable element which is pressed against said corresponding other flat part, in order to cause the lateral retention force due to said spring means to vary inversely with the vertical retention force.

2. A safety binding according to claim 1, wherein said movable elements and said spring means are aligned along an axis parallel to the longitudinal axis of said ski when said binding is in its normal boot-retaining position.

3. A safety binding according to claim 1, wherein said body is contained in a housing, at least one of said movable elements being mounted for translatory motion in said housing.

4. A safety binding according to claim 1, wherein at least one of said movable elements is mounted in said body for rotation about a transverse axis.

5. A safety binding according to claim 1, wherein the widths of said flat parts, measured along a plane parallel to said ski, differ from one another.

6. A safety binding according to claim 5, wherein the movable element cooperating with the component tied to the vertical movement of said boot-retaining means rests against the flat part having the greater width.

7. A safety binding according to claim 1, wherein the movable element which cooperates with said member tied to the vertical movements of said boot-retaining means comprises at least one extension extending inside said body through an aperture in the latter in which aperture said extension can slide, said extension abutting against said vertical retaining means.

8. A safety binding according to claim 7, comprising a housing for said body, said first movable element having an extension and comprising a hollow casing mounted for sliding movement in said housing, said hollow casing being sealed at one of its ends by a screw plug comprising means for adjusting the tension of said spring means, said casing having a flat bottom coacting with one of said flat parts and a transverse passage in which said pivot is set, said second movable element being housed inside said hollow casing between said second movable element and said screw-plug.

* * * * *

UNITED STATES PATENT AND TRADEMARK OFFICE

CERTIFICATE OF CORRECTION

PATENT NO. : 4,402,525

DATED : September 6, 1983

INVENTOR(S) : Salomon

It is certified that error appears in the above-identified patent and that said Letters Patent is hereby corrected as shown below:

On the title page;

In the heading, correct the assignee's name and address as follows:

Etablissements François Salomon et Fils
Chemin de la Prairie Prolonge
Annecy, France Signed and Sealed this

*Thirtieth* Day of *July 1985*

[SEAL]

*Attest:*

DONALD J. QUIGG

*Attesting Officer* *Acting Commissioner of Patents and Trademarks*